US006234935B1

(12) United States Patent
Chu

(10) Patent No.: US 6,234,935 B1
(45) Date of Patent: May 22, 2001

(54) SKATING MOTION EXERCISING MACHINE

(76) Inventor: Yong S. Chu, 16129 Leadwell St., Van Nuys, CA (US) 91406

( * ) Notice: Subject to any disclaimer, the term of this patent is extended or adjusted under 35 U.S.C. 154(b) by 0 days.

(21) Appl. No.: 09/616,710

(22) Filed: Jul. 14, 2000

(51) Int. Cl.[7] ..... A63B 21/00; A63B 23/04
(52) U.S. Cl. ..... 482/51; 482/71
(58) Field of Search ..... 482/51, 57, 70, 482/71, 79, 80, 148, 63

(56) References Cited

U.S. PATENT DOCUMENTS

| | | | | |
|---|---|---|---|---|
| 4,340,214 | | 7/1982 | Schutzer . | |
| 4,781,372 | | 11/1988 | McCormack . | |
| 4,869,496 | | 9/1989 | Colombo . | |
| 4,915,373 | * | 4/1990 | Walker | 482/51 |
| 5,284,460 | | 2/1994 | Miller et al. . | |
| 5,342,264 | | 8/1994 | Gordon . | |
| 5,391,130 | | 2/1995 | Green et al. . | |
| 5,451,194 | | 9/1995 | Harrigan . | |
| 5,520,598 | | 5/1996 | Little . | |
| 5,692,995 | | 12/1997 | Alvarez et al. . | |
| 5,718,658 | | 2/1998 | Miller et al. . | |
| 6,042,511 | * | 3/2000 | Bulloch | 482/71 |

* cited by examiner

*Primary Examiner*—Stephen R. Crow
(74) *Attorney, Agent, or Firm*—Gene Scott-Patent Law & Venture Group

(57) ABSTRACT

A skating training apparatus includes rotating gears positioned in a generally horizontal plane. Linear supporting struts are pivotally attached to the gears for movement therewith and a motion restricting device is engaging with the liner supporting struts and adapted for restricting the linear supporting struts to a combination of pivotal and linear translational motion. Pivots engage the linear supporting struts and restrict it to pivotal motion at one end. Foot rests are mounted on the linear supporting struts at an end opposite to the pivots. The rotating gears, linear supporting struts, motion restricting device and pivots are mutually interconnected for moving the foot rests in a skating motion as driven by a person's feet while training on the apparatus.

8 Claims, 5 Drawing Sheets

SKATING MOTION EXERCISING MACHINE

BACKGROUND OF THE INVENTION

1. Field of the Invention

This invention relates generally to machines used for physical exercise and training and more particularly to an apparatus capable of simulating the motions of an ice or roller skater and useful for training such skaters and for developing muscular strength in the field of skating.

2. Description of Related Art

The following art defines the present state of this field:

Schutzer, U.S. Pat. No. 4,340,214 describes a training apparatus for skaters consisting of a fixed training stand with two carriages transversely displaceable in opposite directions, the displacement of which is controlled. Each carriage has a platform for the attachment of one of the skater's feet, said platform altering its angle of inclination upon displacement of the associated carriage from the initial position in the same way as a skate when cutting the ice. The lateral displacement of each carriage occurs against the action of a force which is adjustable.

McCormack, U.S. Pat. No. 4,781,372 describes an ice-skating leg exercise device utilizing in one embodiment a pair of rotatably positionable tracks each having a stirrup movable back and forth thereon in which the user's legs are positioned, each track being angularly adjustable with adjustable weight resistance provided against the rearward movement of each stirrup and a body support for the user to rest there against while exercising his legs on the device.

Colombo, U.S. Pat. No. 4,869,496 describes a piece of equipment for the simulation of skiing movements which comprises a basic structure which can be stably placed on the ground. An arm is hinged to the basic structure in a median position and is able to oscillate horizontally. The arm carries a pair of boards at its end. Feet are connected to the structure to incline it with respect to the ground. The arm is able to carry out a slight vertical oscillation. The boards are restrained to the arm so that they can rotate around their vertical and horizontal axes, the rotation around the vertical axis being limited by suitable means. Two rods overhang and are connected to the arm by pins. The rods are able to rotate around the vertical axis of these pins, such rotation being made synchronous with that of the boards. The rotation is opposite to the direction of oscillation of the arm. The piece of equipment is also equipped with an electrical detection circuit which detects correct or incorrect movements carried out by the user who, by placing his or her feet on the boards and gripping the rods, gives an oscillating movement to the arm with the help of elastic devices which absorb and give back the kinetic energy produced, thus carrying out the movements required by skiing techniques.

Walker, U.S. Pat. No. 4,915,373 describes a power skating exercise device includes a pair of endless guide tracks, each of which have a power section and a return section and a pedal for each guide track. The pedal is mounted on a follower which is slidably mounted in one of the guide tracks. The follower is proportioned to pass freely along the return section. Drag is applied to the follower as it is driven along the drive section to resist the movement of the follower. A support frame is provided for supporting the user in a forwardly inclined semi-prone position which corresponds to the position assumed by a skater when accelerating forwardly.

Miller et al., U.S. Pat. No. 5,284,460 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Gordon, U.S. Pat. No. 5,342,264 describes an aerobic exercise device which provides for a smooth, natural, orbital continuous motion of the user's feet. This device can be used for walking, running, jogging or stair-stepping exercises. Upper body workout devices can be provided with the aerobic exercise device such that a total body workout can be had. The device includes two parallel tracks with platforms. The platforms reciprocate along the tracks. A device is provided in each track for returning the platforms to the home position. As a user operates the device, he or she will push the platforms rearwardly. When the user's foot reaches the end of his or her stride, the user can then lift their foot in a natural motion. The device will return the platform to the home position. As the platform is returning to the home position, it will first travel in a forward direction and then switch to a rearward direction. This rearward movement will enable comfortable planting of the user's foot as it reengages the platform. The device can be easily accommodated to any desired workout level or to many different sized users.

Green et al., U.S. Pat. No. 5,391,130 describes an exercise apparatus used for leg exercises, and particularly for exercising the muscles used in ice skating. The apparatus has a frame with two four bar linkages arranged side by side. Each linkage carries a foot pad. A resistance unit is attached to each linkage to resist movement of the linkage in both directions. The resistance unit is preferably a double acting hydraulic cylinder connected to variable flow control valves to vary the resistance to linkage movement.

Harrigan, U.S. Pat. No. 5,451,194 describes a roller skate exercise device which consists of a platform having a top surface to support a pair of roller skates worn by a person. Components are for permitting the roller skates to slide in opposed reciprocating motions on the top surface of the platform, so as to simulate cross country skiing.

Little, U.S. Pat. No. 5,520,598 describes a combination leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower legs; the device further including: two track assemblies extending horizontally from the base member; and the track assemblies including thereon two wheeled platforms; such that a person standing with a foot on each of the platforms, slides the platforms back and forth along the track assemblies by alternatingly flexing and relaxing inner and outer muscles in the person's upper legs.

Alvarez et al, U.S. Pat. No. 5,692,995 describes an exercise machine that simulates the movements made during snow skiing and has a pair of foot support arms mounted for limited rotational movement about separate axes of rotation so that foot support portions of the foot support arms move simultaneously both vertically and horizontally, coordinates simultaneous movement of both foot support arms through a gear train coupling the foot support arms. In addition, foot support treads which support the feet of a user of the machine are resiliently mounted to the foot support arms to allow angling of the foot support treads to simulate a feeling of edging of skis.

Miller et al., U.S. Pat. No. 5718,658 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

The prior art teaches physical training machines for a wide range of muscle development and for training endurance. However, the prior art does not teach a truly simple machine capable of true skating motion. The present invention fulfills these needs and provides further related advantages as described in the following summary.

SUMMARY OF THE INVENTION

The present invention teaches certain benefits in construction and use which give rise to the objectives described below.

The invention apparatus comprises a rotating means positioned in a generally horizontal plane. A linear supporting means is pivotally attached to the rotating means for movement therewith and a motion restricting means is engaging with the liner supporting means and adapted for restricting the linear supporting means to a combination of pivotal and linear translational motion. A pivoting means engages the linear supporting means and is adapted for restricting the linear supporting means to pivotal motion at one end. A foot rest means engages the linear supporting means at an end opposite to the pivoting means. The rotating means, linear supporting means, motion restricting means and pivoting means are mutually interconnected for moving the foot rest means in a skating motion as driven by a person training on the apparatus.

A primary objective of the present invention is to provide a skating motion training apparatus having advantages not taught by the prior art.

Another objective is to provide such an invention of simple design and manufacture.

A further objective is to provide such an invention enabled for true skating motion.

A still further objective is to provide such an invention with variable resistance adjustment.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
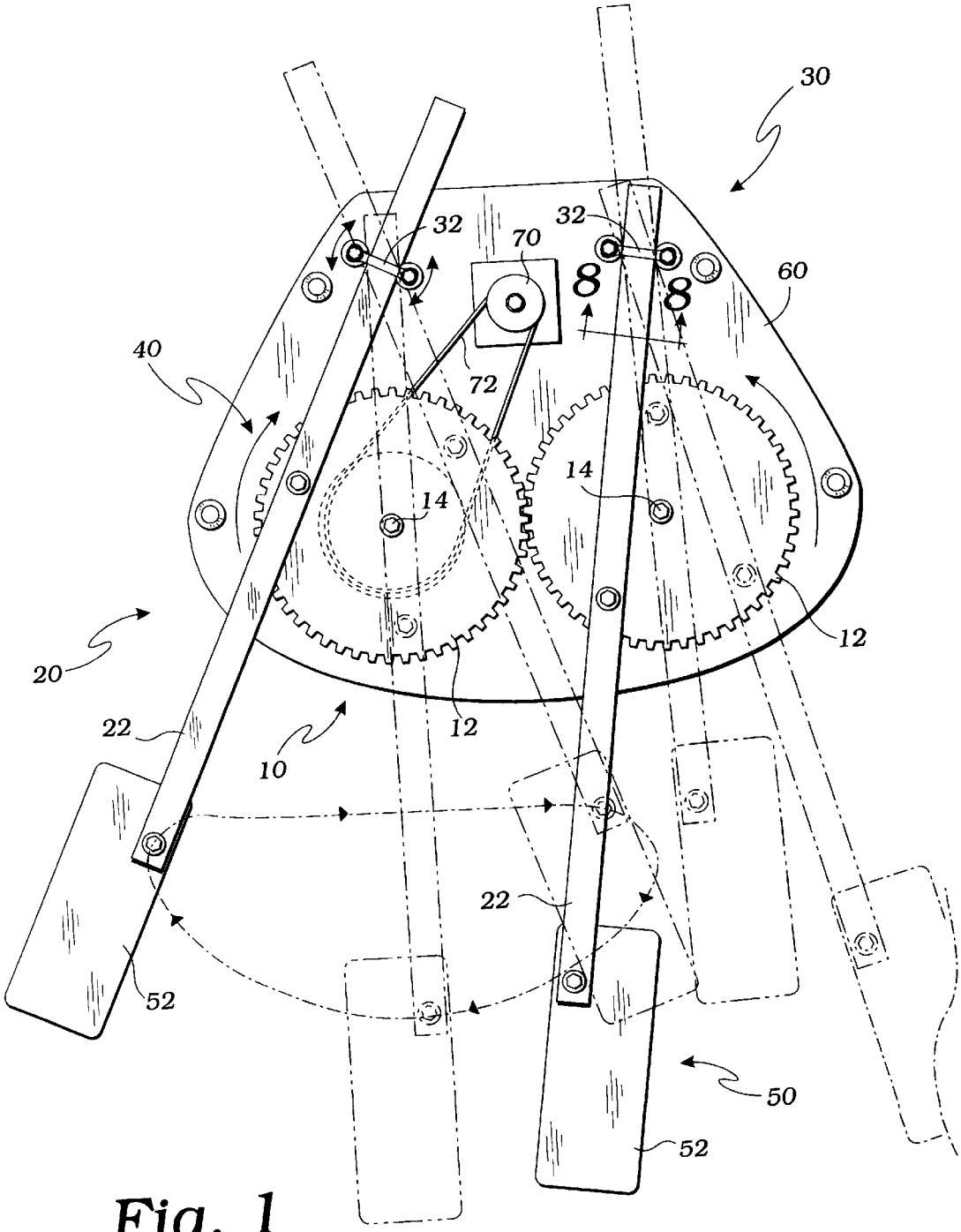
FIG. 1 is a bottom plan view of a preferred embodiment of the invention.
Figure 2:
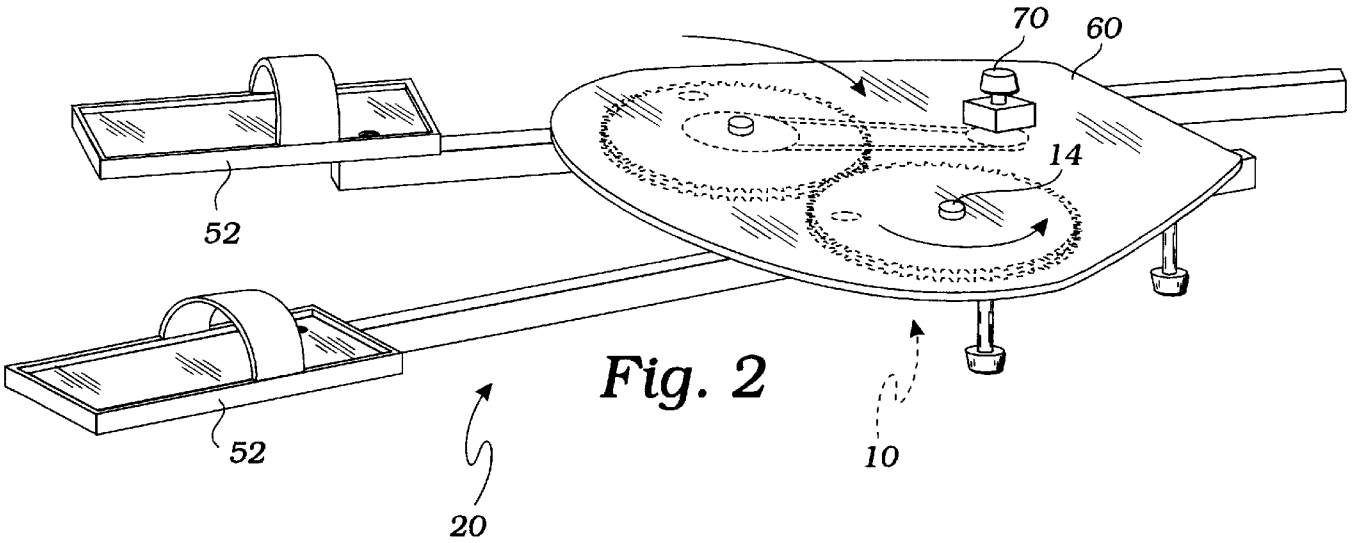
FIGS. 2 and 3 are perspective views thereof.
Figure 3:
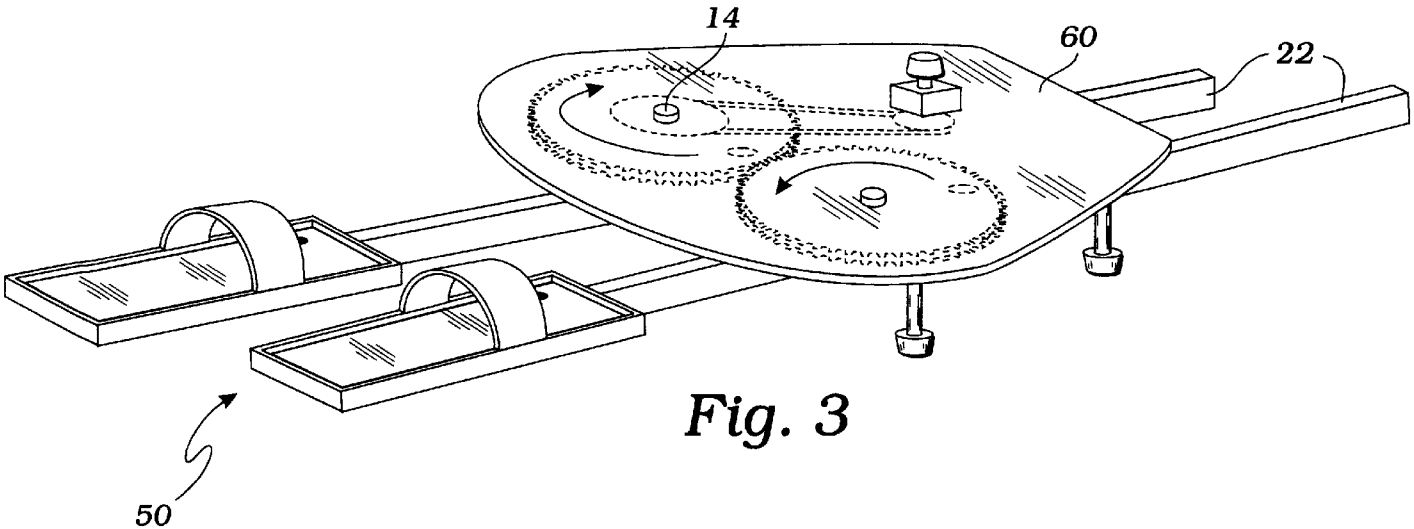
Figure 4:
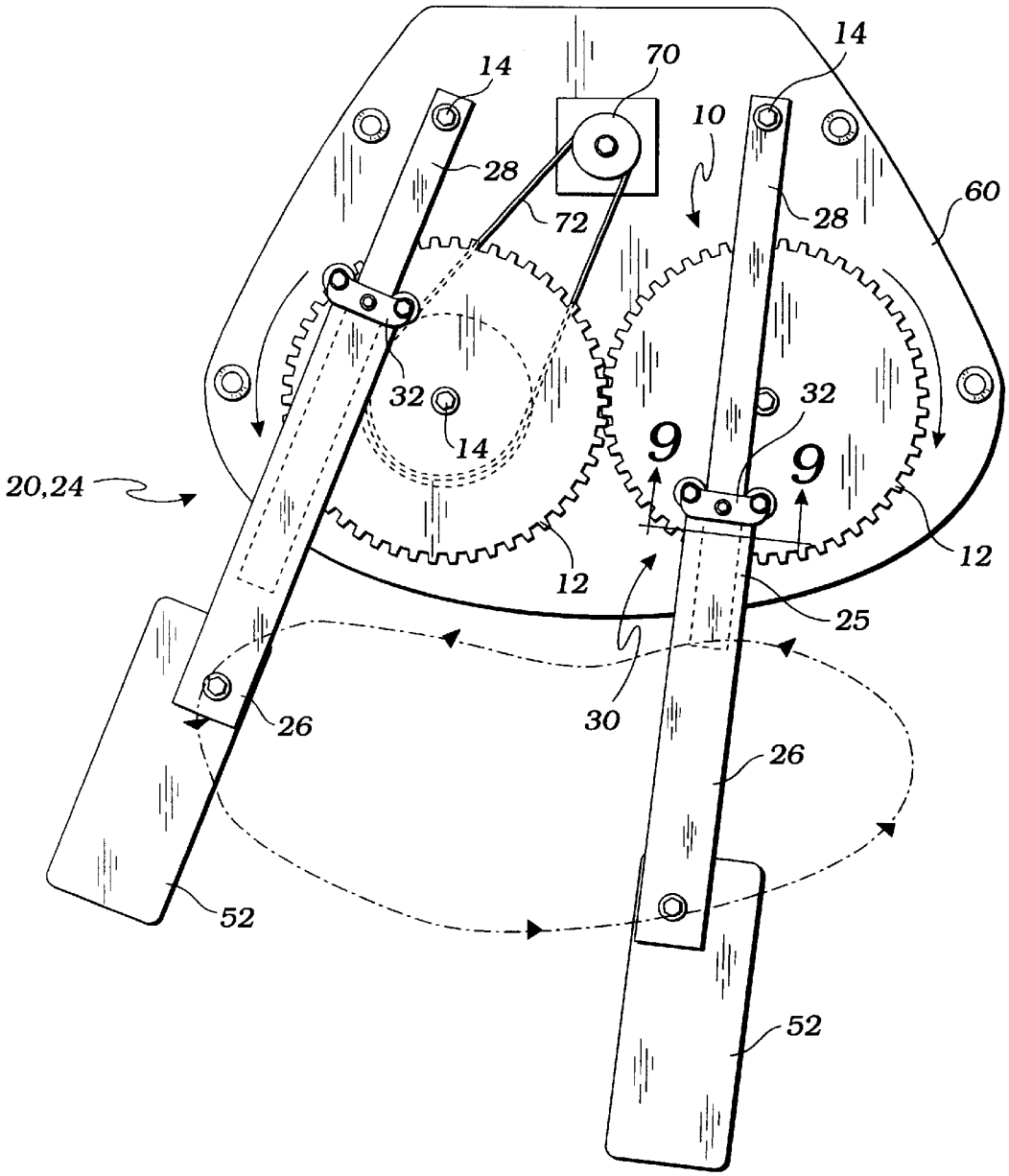
FIGS. 4–7 are bottom plan views of a further preferred embodiment of the invention.
Figure 5:
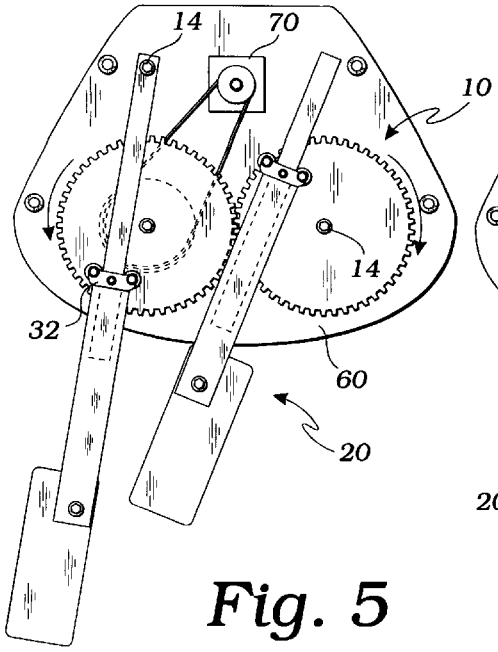
Figure 6:
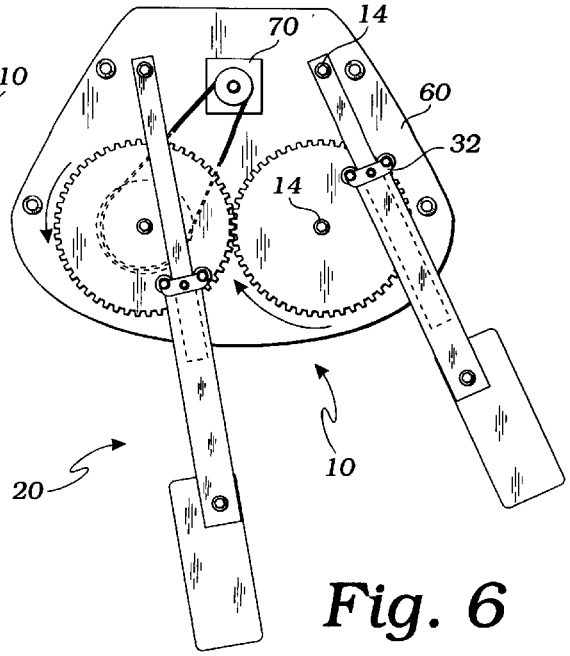
Figure 7:
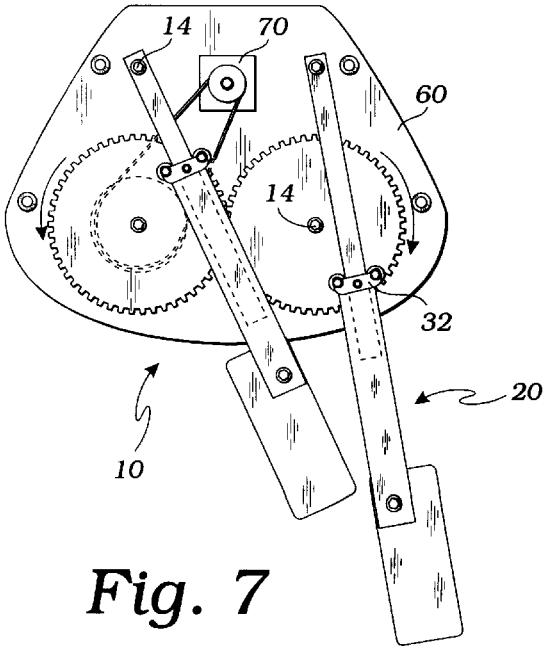

The above described drawing FIGS. 1–8 illustrate the invention, an apparatus for training skaters. The apparatus comprises: a rotating means 10 positioned in a generally horizontal plane, a linear supporting means 20 pivotally mounted on the rotating means 10 and joined with it for mutual movement, a motion restricting means 30 engaging the liner supporting means 20 and adapted for limiting the linear supporting means 20 to a combination of pivotal and linear translational motion, a pivoting means 40 engaging the linear supporting means 20 and adapted for restricting the linear supporting means 20 to pivotal motion, and a foot rest means 50 engaging the linear supporting means 20 distally with respect to the motion restricting means 30 and the pivoting means 40. The rotating means 10, linear supporting means 20, motion restricting means 30 and pivoting means 40 are mutually interconnected, as shown in the figures, for moving the foot rest means 50 in a skating motion. These elements will be further described and there relationships to one another will be further developed in the following paragraphs.

The rotating means 10 is preferably a pair of mutually engaged circular gears 12 as shown in the figures. The gears provide exterior teeth and, as shown in the figures, move only with rotational mutual motion, i.e., both gears 12 move at the same time and in opposite senses of rotation. These gears 12 are rotationally joined to a rigid support plate 60, by and, for rotation about spaced apart gear axles 14 where the gears 12 are mounted in a manner that would be obvious to one of skill in the art. The gears 12 are preferably positioned for rotation in a generally horizontal plane for reasons that will become apparent in the following description.

Figure 8:
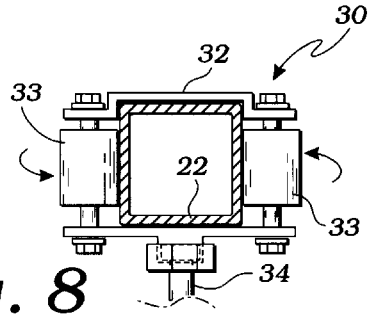
FIGS. 8 and 9 are section views taken along lines 8—8 and 9—9 from FIGS. 1 and 4 respectively.
Figure 9:
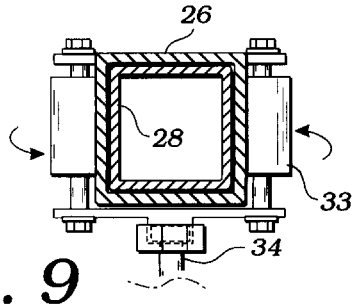
Figure 10:
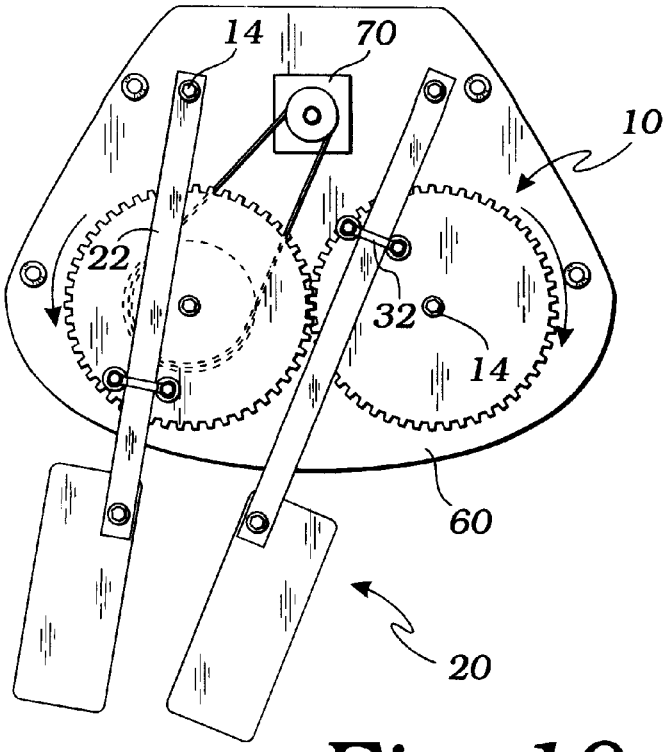
FIGS. 10–11 are bottom plan views of a further embodiment of the invention.
Figure 11:
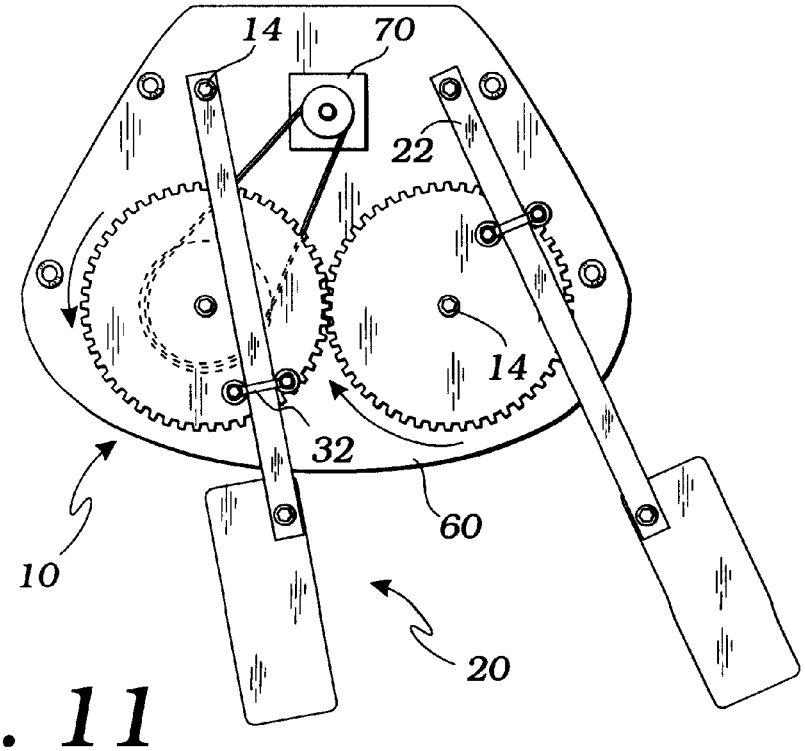

In one preferred embodiment, the linear supporting means 20 is a pair of simple elongate rigid struts 22 preferably of square cross-section, as shown in FIGS., 1–3, where each one of the struts 22 is medially, pivotally, joined to one of the gears 12. The pivotal joining is by a simple pivot shaft in hole type mounting, as represented by pivot axles 14, allowing the struts 22 to move freely with respect to the gears 12. In this embodiment, the motion restricting means 30 is preferably a pair of strut guides 32. Each one of the guides 32 is pivotally joined to the support plate 60, as shown in FIG. 8 for free rotational motion about a guide axle 34. The guides 32 are each adapted by providing opposing rollers 33 for receiving one of the struts 22 distally, in linear sliding and pivotal motion. The rollers 33 are in mutual compression against opposing sides of the struts 22. The foot rest means 50 is preferably a pair of support platforms 52, together adapted for supporting an athlete (not shown), where each one of the platforms 52 is joined proximally on one of the struts 22 and receives one of the feet of the athlete.

In a second preferred embodiment, shown in FIGS. 4–7, the motion restricting means 30 is the same pair of strut guides 32, but each one of the guides 32 is pivotally joined to one of the gears 12 for rotational motion about guide axle 34, and the guides 32 rotate with the gears 12. The linear supporting means 20, in this embodiment, is a pair of elongate rigid strut assemblies 24 comprising an outer tube 26 and, therewithin, a proximal end 27 of an inner shaft 28 for sliding telescopic linear motion within the outer tube 26. Each one of the outer tubes 26 is joined integrally to one of the guides 32 by common fasteners, welding or equivalent process, at a distal end 25 of the outer tube 26. Each one of the inner shafts 28 is pivotally joined to the support plate 60 as is clearly shown in the FIGS. 4–7 and such a simple and common pivot is preferably as described above. The foot rest means 50 are as described above and are joined proximally on one of the outer tubes 26.

In operation, the apparatus functions to force the platforms 52 to move in a motion similar to that of a skater and thereby allows a skater to train on the apparatus. An adjustable resistance 70 is provided so that the training program may be made more, or less, difficult. Such a resistance may be a clutch type mechanism or a motor-generator, etc. as is well known in the training equipment field. Connection between the resistance 70 and the apparatus may be by a belt 72 as is shown in the figures, or by any other means of well known design.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for physical training, the apparatus comprising:

rotating means positioned in a generally horizontal plane;

linear supporting means pivotal on the rotating means for movement therewith;

motion restricting means engaging the liner supporting means and adapted for restricting the linear supporting means to pivotal and linear translational motion;

pivoting means engaging the linear supporting means and adapted for restricting the linear supporting means to pivotal motion; and foot rest means engaging the linear supporting means distally from the motion restricting means and the pivoting means;

the rotating means, linear supporting means, motion restricting means and pivoting means mutually interconnected for moving the foot rest means in a skating motion.

2. The apparatus of claim 1 wherein the rotating means is a pair of mutually engaged circular gears rotationally joined to a rigid support plate for rotation about spaced apart gear axles, the gears positioned for rotation in a generally horizontal plane.

3. The apparatus of claim 2 wherein the linear supporting means is a pair of elongate rigid struts, each one of the struts medially thereat and pivotally joined to one of the gears.

4. The apparatus of claim 3 wherein the motion restricting means is a pair of strut guides, each one of the guides pivotally joined to the support plate for rotational motion about spaced apart guide axles, the guides each adapted for receiving one of the struts distally therewith, in linear sliding and pivotal motion.

5. The apparatus of claim 4 wherein the foot rest means is a pair of support platforms, together adapted for supporting an athlete, each one of the platforms joined with one of the struts proximally thereon.

6. The apparatus of claim 2 wherein the motion restricting means is a pair of strut guides, each one of the guides pivotally joined to one of the gears for rotational motion about a guide axle.

7. The apparatus of claim 6 wherein the linear supporting means is a pair of elongate rigid strut assemblies comprising an outer tube and, therewithin, a proximal end of an inner shaft engaged therewith for sliding telescopic linear motion relative to the outer tube, each one of the outer tubes of the strut assemblies distally thereat, joined integrally to one of the strut guides, each one of the inner shafts distally therewith, pivotally joined to the support plate.

8. The apparatus of claim 7 wherein the foot rest means is a pair of support platforms, together adapted for supporting an athlete, each one of the platforms joined with one of the outer tubes proximally thereon.

* * * * *